US006739590B2

(12) United States Patent
Otsuka

(10) Patent No.: US 6,739,590 B2
(45) Date of Patent: May 25, 2004

(54) PAPER-LIKE MATERIALS PROCESSING APPARATUS

(75) Inventor: Toru Otsuka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 122 days.

(21) Appl. No.: 10/086,439

(22) Filed: Mar. 4, 2002

(65) Prior Publication Data

US 2002/0153291 A1 Oct. 24, 2002

(30) Foreign Application Priority Data

Apr. 20, 2001 (JP) ..... 2001-122888

(51) Int. Cl.[7] ..... B65H 7/02; B65H 9/00

(52) U.S. Cl. ..... 271/227; 271/228; 271/236

(58) Field of Search ..... 271/225, 226, 271/227, 228, 229, 230, 234, 236, 239, 253; 209/534

(56) References Cited

U.S. PATENT DOCUMENTS

| | | | | | |
|---|---|---|---|---|---|
| 4,487,306 | A | | 12/1984 | Nao et al. | 194/4 C |
| 4,855,607 | A | | 8/1989 | Eckl | 250/557 |
| 5,169,140 | A | * | 12/1992 | Wenthe, Jr. | 271/228 |
| 5,172,907 | A | * | 12/1992 | Kalisiak | 271/227 |
| 5,522,511 | A | * | 6/1996 | Sakoguchi et al. | 209/534 |
| 5,748,483 | A | | 5/1998 | Richardson et al. | 364/478.11 |
| 5,755,437 | A | * | 5/1998 | Ek | 271/227 |
| 5,867,589 | A | | 2/1999 | Graves et al. | 382/185 |
| 6,019,365 | A | | 2/2000 | Matsumura | 271/227 |
| 2003/0057637 | A1 | * | 3/2003 | Kawamura et al. | 271/227 |

FOREIGN PATENT DOCUMENTS

| | | | | |
|---|---|---|---|---|
| EP | 0612043 | | 8/1994 | G07D/7/00 |
| JP | 61 273449 | | 12/1986 | B65H/9/16 |
| JP | 03 251982 | | 11/1991 | G07D/7/00 |
| JP | 5-221564 A | * | 8/1993 | B65H/9/16 |
| JP | 6-183605 A | * | 7/1994 | B65H/7/14 |
| JP | 09 212707 | | 8/1997 | G07D/7/00 |

* cited by examiner

*Primary Examiner*—Donald P Walsh
*Assistant Examiner*—Mark J Beauchaine
(74) *Attorney, Agent, or Firm*—Pillsbury Winthrop, LLP

(57) ABSTRACT

A banknote receiving machine conveys inserted banknotes on a conveying path and corrects their conveying posture by a posture correction device. Downstream of the posture correction device, sensors detect features of banknotes from feature portions thereof. Kinds and directions of the front/back and the top/bottom of banknotes are detected by posture detecting sensors that are provided in front of the posture correction device. Position correction amounts are acquired corresponding to the kinds and the directions of the banknotes from a memory. Conveying postures are corrected based on position correction amounts and the feature portions of the banknotes in alignment with the conveying posture correcting sensors.

12 Claims, 13 Drawing Sheets

| EURO (€) | | DEUTSCHE MARK (DM) | | | FRANC (F.,Fr.) | | KOREA WON (₩) | | AUSTRALIA DOLLAR ($A) | |
|---|---|---|---|---|---|---|---|---|---|---|
| KIND OF MONEY | SIZE | KIND OF MONEY | SIZE | RATIO | KIND OF MONEY | SIZE | KIND OF MONEY | SIZE | KIND OF MONEY | SIZE |
| 5 | 62*120 | (5) | (62*122) | 0.11 | 20 | 75*140 | 1000 | 76*151 | 1 | 70*140 |
| 10 | 67*127 | 10 | 65*130 | 10.7 | 50 | 80*123 | 5000 | 76*156 | 2 | 72.5*145 |
| 20 | 72*133 | 20 | 68*138 | 19.3 | 100 | 80*133 | 10000 | 76*161 | 5 | 65*130 |
| 50 | 77*140 | 50 | 70*145 | 27.0 | 200 | 80*143 | | | 10 | 65*137 |
| 100 | 82*147 | 100 | 74*154 | 38.3 | 500 | 80*153 | | | 20 | 65*144 |
| 200 | 82*153 | (200) | (77*162) | 0.24 | | | | | 50 | 65*151 |
| 500 | 82*160 | (500) | (80*170) | 0.21 | | | | | 100 | 65*158 |
| | | (1000) | (83*178) | 0.01 | | | | | | |

FIG.7

| KIND OF MONEY / DIRECTION | FF BANKNOTE | FR BANKNOTE | BF BANKNOTE | BR BANKNOTE |
|---|---|---|---|---|
| DM10 | -dL1 | +dR1 | +dR1 | -dL1 |
| DM20 | -dL2 | +dR2 | +dR2 | -dL2 |
| DM50 | +dR3 | -dL3 | -dL3 | +dR3 |
| DM100 | +dR4 | -dL4 | -dL4 | +dR4 |

FIG.8

PAPER-LIKE MATERIALS PROCESSING APPARATUS

CROSS-REFERENCE TO RELATED APPLICATION

This application is based upon and claims the benefit of priority from the prior Japanese Application No. 2001-122888, filed on Apr. 20, 2001; the entire contents of which are incorporated herein by reference.

BACKGROUND OF THE INVENTION

1. Field of the Invention

The inventions relate to a paper-like materials processing apparatus which processes paper-like materials taken out on a conveying path by detecting their features and, more particularly, to a banknote receiving machine which takes out banknotes one by one on a conveying path, conveys, detects features such as kinds and directions of banknotes, uniformly arranges the front/back and the top/bottom and accumulates them by kind.

2. Description of the Related Art

A banknote receiving apparatus is so far known as a paper-like materials processing apparatus. For example, plural kinds of banknotes are collectively inserted into this banknote receiving apparatus in mix and these inserted banknotes are taken out on a conveying path one by one, its feature is detected and the front/back and the top/bottom are arranged uniformly and accumulated by kind.

However, a banknote size differs according to kind and the feature position also differs depending on kind. Therefore, depending on the position of a detecting portion arranged for detecting banknote features, the detecting portion may not be in alignment with the feature portion and there may be banknotes of which features cannot be detected precisely. So, in a conventional apparatus, many detectors are provided in the cross direction of a conveying path so that features of banknotes are detected precisely even when the feature portion passes any position. Accordingly, there were such problems that it was necessary to provide many detectors, the structure of apparatus was complicated and the manufacturing cost was increased.

Furthermore, in a conventional apparatus, there were such problems that when the banknote conveying posture was tilted to the conveying path (skew) and/or one-sided (shift) to the cross direction of the conveying path, banknotes were conveyed on the conveying path in such improper posture and the feature detecting accuracy of banknotes by the detector was further reduced.

SUMMARY

The inventions provide a paper-like materials processing apparatus that is capable of simplifying the structure of a detector for detecting features of paper-like materials and capable of detecting features of paper-like materials precisely.

According to embodiments of the inventions there is provided a paper-like materials processing apparatus comprising: an insert port into which paper-like materials are inserted; a conveying portion to convey the paper-like materials that are taken out on a conveying path from the insert port; a first detecting portion to detect kinds and directions relative to the front/back and top/bottom of the paper-like materials that are conveyed by the conveying portion; a posture correcting portion to correct the conveying posture of the paper-like materials passed through the first detecting portion; a second detecting portion that is opposed to feature portions of the paper-like materials passed through the posture correcting portion to detect features of the paper-like materials from the feature portions; a storage portion to store position correction amounts by the posture correcting portion that are preset according to kinds and directions of paper-like materials so as to align the feature portions of paper-like materials passed through the posture correction portion with the second detecting portion; and a controller to read out correction amounts corresponding to kinds and directions of paper-like materials detected through the first detecting portion and control the posture correcting portion so as to correct the conveying posture of the paper-like materials based on the read out correction amounts.

BRIEF DESCRIPTION OF THE DRAWINGS

FIG. 7 is a turntable for judging kind of banknote that is to be referred to in the posture correcting operation;

FIG. 8 is a table showing movement correction data of Deutsche mark banknotes that are to be referred to in the posture correction operation;

DETAILED DESCRIPTION

Figure 1:
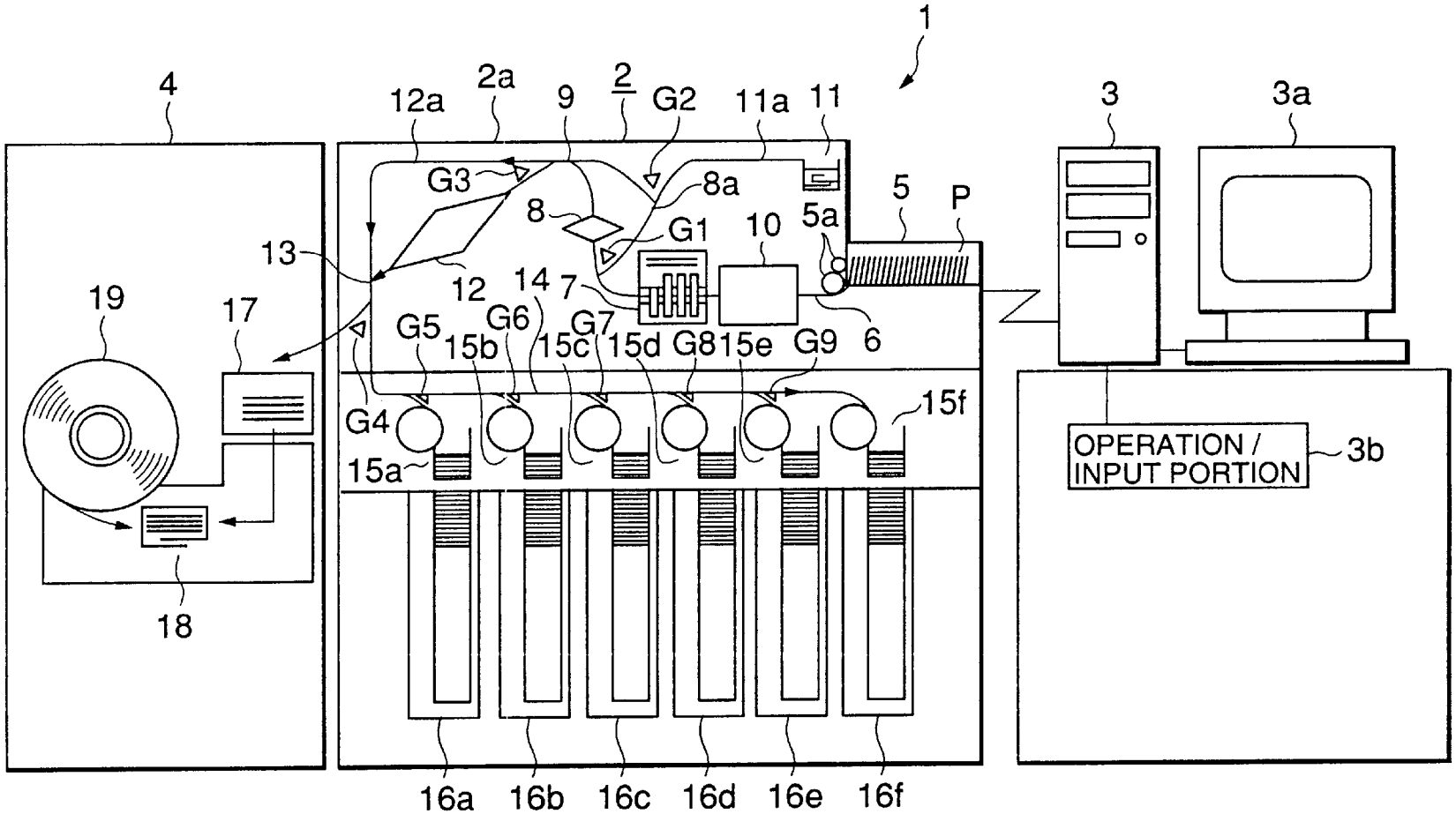
FIG. 1 is a schematic diagram showing a banknote receiving machine involved in an embodiment of the inventions.

A preferred embodiment of the present invention will be described below in detail referring to the drawings.

FIG. 1 shows a schematic structure of a banknote receiving machine 1 (a paper-like document processing apparatus) involved in the embodiment of the present invention. The banknote receiving machine 1 receives banknotes P in plural kinds (nominal values) and different sizes (paper-like materials in a rectangular shape) inserted collectively in mix and accumulates by uniformly arranging the front/back and the top/bottom in the same direction and classifying them by kind.

The banknote receiving machine 1 comprises a banknote processing portion 2, a tellers machine 3 and a banding processor portion 4. The tellers machine 3 is a personal computer with a dedicated application software incorporated, and operates the banknote processing portion 2 and controls its operations. Further, a monitor 3*a* (a display portion) for displaying various information to worker and an operation/input portion 3*b* (a mode selecting portion) for accepting various kinds of operation inputs by worker are connected to the tellers machine 3. The banding processor portion 4 forms a bundle of the same kind of banknotes processed in the banknote processing portion 2 by binding 100 sheets with a paper strip.

The banknote processing portion 2 has a housing in almost rectangular shape that becomes its outer body. On the upper right portion of the housing 2 shown in FIG. 1, there is an insert port 5 into which plural number of banknotes P accumulated in the surface direction are inserted collectively in the erected state in the cross direction. The insert port 5 arranges banknotes P by bringing the longitudinal lower end sides (one long end side) in contact with the stage and the banknotes on the stage at the left end in FIG. 1 are pressed against take-out rollers 5*a* (a take-out portion) by moving a back-up plate (not shown) in the face direction of the banknotes P along the stage. When the take-out rollers arranged vertically on the left end of the stage are turned, the banknotes P on the stage are taken out on a conveying path 6 in order from the lower side of the banknotes on the left end.

On the conveying path 6 near the insert port 5, there is provided a posture correction device 10 (a posture correcting portion) which will be described later in detail. The posture correction device 10 corrects skew and shift of banknotes for preventing improper posture of banknotes; in other words, defects that are caused from skew and shift in respective processing portions provided on the conveying path 6 at downstream side from the posture correction device 10. In this embodiment, the posture of banknotes P are corrected by the posture correction device 10 so that the center of the banknotes taken out in the cross direction is basically positioned on the center line 6*a* of the conveying path 6 and the long end side along the longitudinal direction of banknotes P becomes orthogonal to the center line 6 (this posture is the standard posture).

On the conveying path 6 immediately behind the posture correction device 10, a detector 7 is provided for detecting such features of banknotes P as kind, front/back, ton/bottom, presence of soil and damage, etc. The detector 7 reads various kinds of information from the surfaces of banknotes P being conveyed on the conveying path 6, logically computing the read information, compares with information that becomes the standard and detects the features of banknotes P as described above.

On the conveying path 6 at the downstream side from the detector 7, plural gates G1~G9 are provided for selectively switching the conveying direction of banknotes P according to the result of detection by the detector 7.

On one of the conveying paths branched at the position of the gate G1 provided at the most upper stream side, a switchback mechanism 8 is provided. The switchback mechanism 8 functions to reverse the top/bottom by reversing the conveying direction of banknotes P conveyed via the gate G1 and again sends out them on the conveying path. The other conveying path branched at the position of the gate G1 functions as a detour conveying path 8*a* to detour the switchback mechanism 8. The detour conveying path 8*a* is set in such a length that banknotes P passed through the switchback mechanism 8 via the gate G1 and banknotes P passed through the detour conveying path 8*a* reach a joining portion 9 at the same time interval.

The detour conveying path 8*a* is branched to a rejection root path 11*a* at the middle way to the joining portion 9 and at this branching position, a gate G2 is provided. At the end of the rejection root path 11*a* branched via the gate G2, a rejection box 11 (a rejection portion) is provided for rejecting banknotes P that are to be rejected. Banknotes P to be rejected are banknotes that were taken in two sheets, those judged to have largely skewed more than a prescribed level, damaged and false banknotes judged not to be regular banknotes that can be circulated again (not limited to banknotes), which are judged in the latter stage processing devices. Further, banknotes of which features could not be detected in the detector 7 are also rejected to the rejection box 11. The rejection box 11 is provided above the insert port 5 and accessible from the outside of the housing 2*a*.

The conveying path 6 at the downstream side of the joining portion 9 is branched again in two directions and a gate G3 is provided at this branch position. On the one of the conveying paths branched at the position of the gate G3, a front/back reversing mechanism 12 is provided. The front/back reversing mechanism 12 has a twist conveying path that is twisted by 180° around the central shaft from the entrance to the exit. When passing through this twist conveying path, the front/back of banknotes P are reversed. The other conveying path branched at the position of the gate G3 functions as a detour conveying path 12*a* to detour the front/back reversing mechanism 12. The detour conveying path 12*a* is set in such a length that banknotes P passed the twist conveying path 12 of the front/back reversing mechanism 12 via the gate G3 and banknotes P passed the detour conveying path 12*a* arrive at the joining portion 13 at the same time interval.

One of the conveying paths branched in two directions at the position of the gate G4 at the further downstream side of the joining portion 13 functions as a horizontal conveying path 14 that is extending almost horizontally in the right direction in FIG. 1. On the horizontal conveying path 14, remaining five gates G5–G9 are provided at almost equal spaces. At positions branched below the horizontal conveying path 14 by the gates G5, G6, G7, G8 and G9, six accumulating portions 15*a*–15*f*, which are more than the number of gates by one, are provided. Further, below these accumulating portions 15*a*–15*f*, stackers 16*a*–16*f* are provided corresponding to the accumulating portions on the one-for-one basis for receiving and stacking banknotes in the accumulating portions 15*a*–15*f*.

The banknotes P passed through the joining portion 13 selectively pass through the above-mentioned switchback mechanism 8 and/or the front/back reversing mechanism 12 and the front/back and the top/bottom are arranged in the same direction. Thus, the front/back and the top/bottom of banknotes P are properly arranged and accumulated in respective accumulating portions.

The other conveying path branched at the position of the gate G4 is led out of the banknote processing portion 2 and is extending to the above-mentioned banding processor portion 4. The front/back and the top/bottom of the banknotes P are arranged in the same direction when passed the joining portion 13 as described above and therefore, the same kind of banknotes P with the front/back and the top/bottom arranged in the same direction only are conveyed into the banding processor portion 4.

The banding processor portion 4 has an accumulation portion 17 for accumulating conveyed banknotes P, a banding portion 18 for banding 100 sheets of banknotes P accumulated in the accumulation portion 17 with a paper strip, and a strip supply portion 19 for supplying paper strips that are used in the banding portion 18. The banknotes P accumulated in the accumulating portion 17 are banded with a paper strip for every 100 sheets and carried out from the banknote receiving machine 1 through a conveyor (not shown).

Figure 2:
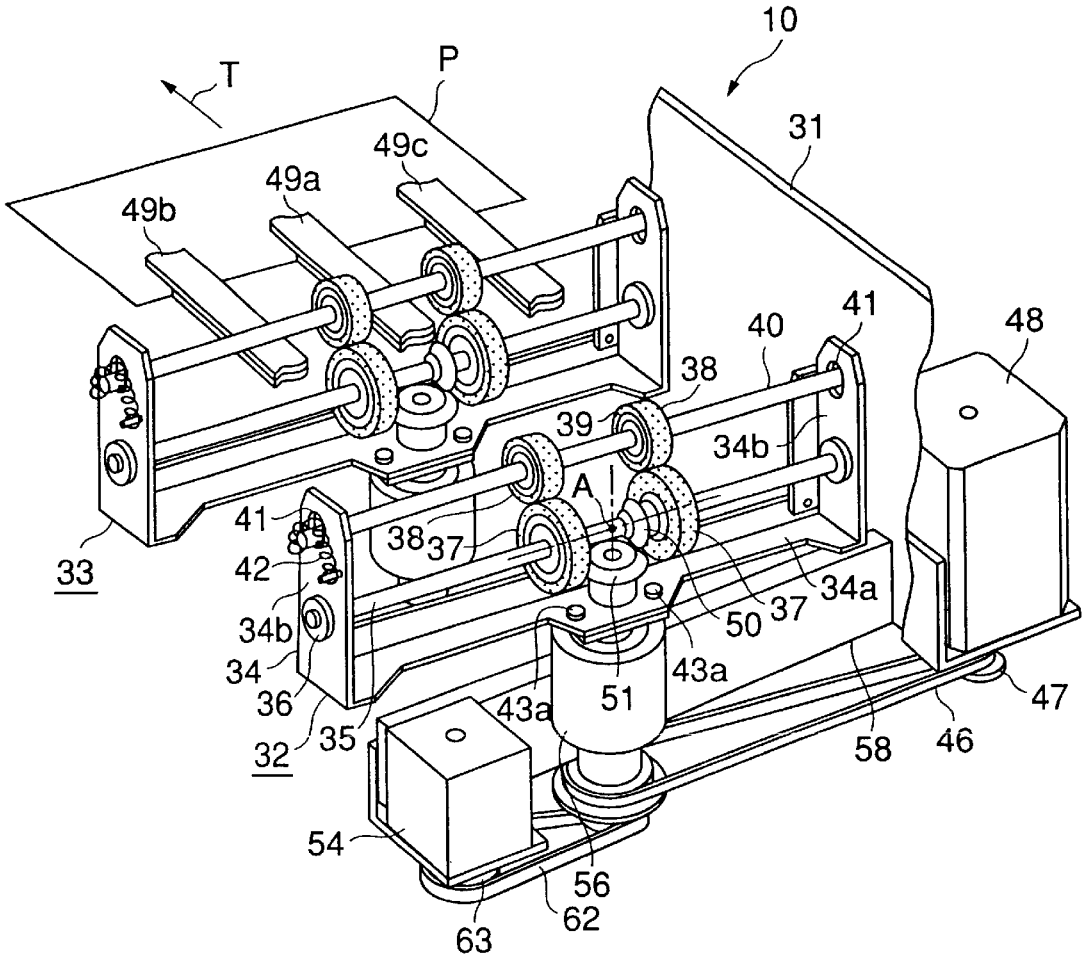
FIG. 2 is a perspective view showing a posture correction device incorporated in the banknote receiving machine shown in FIG. 1.
Figure 3:
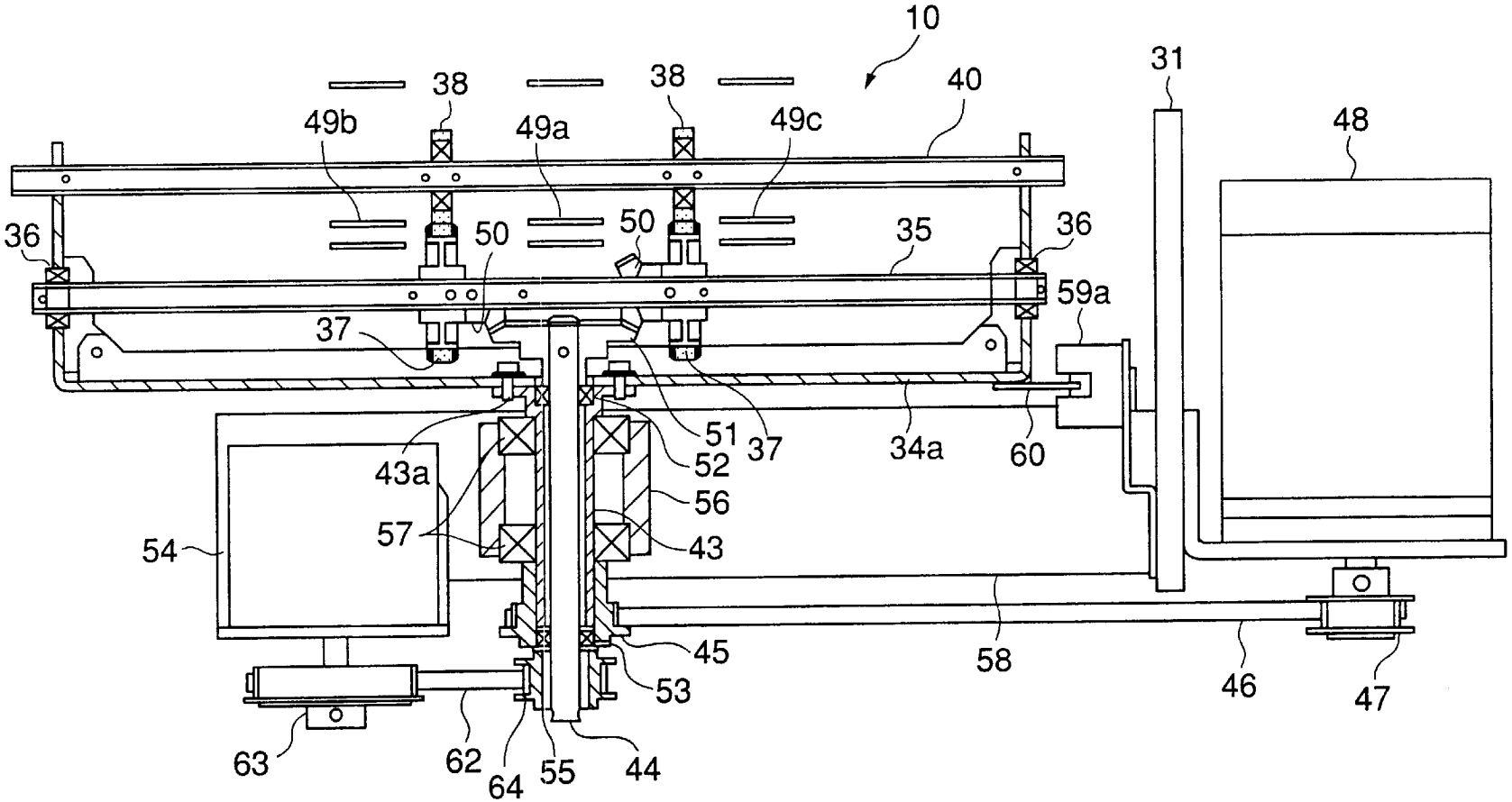
FIG. 3 is a sectional view showing the posture correction device shown in FIG. 2.

Next, the posture correction device 10 described above will be explained in detail referring to FIG. 2 and FIG. 3. FIG. 2 is a perspective view showing a schematic structure of the posture correction device 10 and FIG. 3 is a sectional view showing the section of the posture correction device 10.

The posture correction device 10 has a first and a second correction mechanisms 32 and 33 along the banknote conveying direction (the arrow direction T in FIG. 2). The first and second correction mechanisms 32 and 33 are mounted to a base plate 31 that is erected at the rear side of the posture correction device along the conveying path 6. As the first and second correction mechanisms are in the almost same structure, the first correction mechanism 32 will be explained as a representative and the explanation of the second correction mechanism 33 will be omitted here.

The first correction mechanism 32 has a support frame 34 of which both ends of a long and narrow plate member are bent to the same side almost at a right angle. In other words, the support frame 34 has a frame base portion 34*a* which is at least longer than the long end length of maximum size banknotes P which are conveyed on the conveying path 6 and two side walls 34*b* and 34*b* which are bent almost at a right angle from both ends of this frame base portion 34*a*.

Between two side walls 34*b* and 34*b*, a drive shaft 35 is put via bearings 36 and 36. Two rollers 37 and 37 are mounted to the drive shaft 35. The outer surfaces of these two rollers 37 and 37 are formed with a rubber material so as to increase a frictional force. Above these two rubber rollers 37 and 37, two rubber rollers 38 and 38 are provided to contact the rubber rollers 37 and 37 correspondingly. Two rubber rollers 38 and 38 are mounted to a shaft 40 via a shaft 39. Both ends of the shaft 40 are fit into bearing grooves 41 which are formed on the side walls 34*b* and 34*b* of the support frame 34 and compressed downward by springs 42 provided on the outsides of the wide walls 34*b* and 34*b*. That is, two rubbers 38 and 38 are compressed against two corresponding rubber rollers 37 and 37, and these four rubber rollers 37 and 38 function as the correction rollers 37 and 38.

The correction rollers 37 and 38 are provided in the nested state (alternately) among three conveyor belts 49*a*, 49*b* and 49*c* which are extending along the conveying path 6 by passing through the posture correction device 10. That is, the rollers 37 and 38 at the front side of the device are provided between the first and second conveyor belts 49*a* and 49*b*, and the rollers 37 and 38 at the rear side of the device are provided between the first and third conveyor belts 49*a* and 49*c*.

Further, three sets of the conveyor belts 49*a*, 49*b* and 49*c* are provided over the overall length of the conveying path 6 extending through the banknote receiving machine 1, opposing to each other to clamp the conveying path 6, wound round rollers (not shown) and function as the conveying portion of the present invention.

More in detail, the first conveyor belts 49*a* at the center are extending on the center line 6*a* of the conveying path 6 at its upper and lower surfaces, contacting each other via the conveying path 6 and thus, defines the top and lower sides of the conveying path 6 jointly with the second and third conveyor belts 49*b* and 49*c*. Further, two rollers 37 and 37 out of the correction rollers are arranged at the lower surface side of the conveying path 6 and other two rollers 38 and 38 are arranged at the upper surface side. The conveying path 6 is defined between these two sets of correction rollers 37 and 38.

To the drive shaft 35 provided and extending in the direction crossing the conveying path 6 at its lower side, a bevel gear 50 is stationary mounted to the same shaft. The bevel gear 50 is provided between two rollers 37 and 37 and engaged with another bevel gear 51. The another bevel gear 51 is stationary mounted to the upper end of a driving shaft 44 that is provided extending almost in the vertical direction. Further, the upper end of the driving shaft 44 is opposing to the central portion of the drive shaft 35 equipped with the roller 37.

The driving shaft 44 is inserted into a cylindrical shaft 43 provided to the same shaft and held rotatably by an upper bearing 52 and a lower bearing 53. The lower bearing 53 is mounted in the inside of a pulley 45 fixed to the cylindrical shaft 43. A pulley 64 is mounted to the driving shaft 44 near its lower end via a one-way clutch 55. The rotary shaft of a stepping motor 54 is connected to the pulley 64 via a belt 62 and a pulley 63.

When the stepping motor 54 is rotated and driven, the driving force is transmitted to the driving shaft 44 via the pulley 63, the belt 62 and the pulley 64, and the driving shaft 44 is rotated. The driving shaft 44 rotates in one direction only by the action of the one-way clutch 55. When the driving shaft 44 is rotated in a specified direction, the bevel gear 51 mounted to its top is rotated and the driving shaft 35 is rotated via the bevel gear 50. When the driving shaft 35 is rotated, two rubber rollers 37 and 37 are rotated and two rubber rollers 38 and 38 which are press contacted to these two rubber rollers 37 and 37 are also rotated. When four correction rollers 37 and 38 are rotated, banknotes P are clamped by two nips between the rollers and conveyed along the conveying path 6. Further, the spring 42 is set at a strength so that the banknote P clamping force of the correction rollers 37 and 38 of the posture correction device 10 becomes stronger than the banknote P force of the conveyor belts 49*a*–49*c*.

On the other hand, the cylindrical shaft 43 is held rotatably in the almost cylindrical shape housing 56 via a bearing 57. The upper end of the cylindrical shaft 43 is fixed to the central portion of the frame base portion 34*a* of the support frame 34 by two screws 43*a*. To the pulley stationary provided at the lower end of the cylindrical shaft 43, the rotary shaft of the stepping motor 48 is connected via the belt 46 and the pulley 47. The housing 56 in which the cylindrical shaft 43 is held rotatably is fixed to the base plate 31 via the almost rectangular shape plate 58. This plate 58 is fixed to the base plate 31 in the cantilevered state.

Further, a sensor 59*a* is provided to the base plate 31 for detecting the home position of the first correction mechanism 32. The support frame 34 is provided with a detected member 60 for shielding the light axis of the sensor 59*a* during its rotation. That is, the first correction mechanism 32 is arranged at the home position as the stepping motor is stopped to rotate at the point of time when the detected member 60 shields the light axis of the sensor 59*a*. The home position referred to here is a posture of the rotary shafts of the correction rollers 37 and 38 orthogonal to the conveying direction.

Further, two sensors 59*b* and 59*c* (see FIG. 6) are mounted to the base plate 31 in addition to the sensor 59*a* for detecting the detected member 60 when the first correction member 32 rotates at a specified angle in both directions from the home position. These two sensors 59*b* and 59*c* are provided for detecting the shake-off positions of the first correction mechanism 32. The shake-off positions referred to here are both end positions of the rotatable range of the first correction mechanism 32. Further, these three sensors 59*a*, 59*b* and 59*c* are composed of a photo-interrupter that is turned ON/OFF when the light axis is shielded by the detected member 60, etc.

When the stepping motor 48 is rotated and driven, the driving force is transmitted to rotate the cylindrical shaft 43 via the pulley 47, the belt 46 and the pulley 45. When the cylindrical shaft 43 is rotated, the support frame 34 fixed to the top of the cylindrical shaft 43 is rotated. That is, the first correction mechanism 32 is rotated and the directions of the correction rollers 37 and 38 are varied. Further, the rotating position of the first correction mechanism 32 wherein the detected member 60 is detected by the central sensor 59*a* is regarded as its home position and can be adjusted to an optional position by controlling the number of steps of the stepping motor 48 therefrom.

Figure 4:
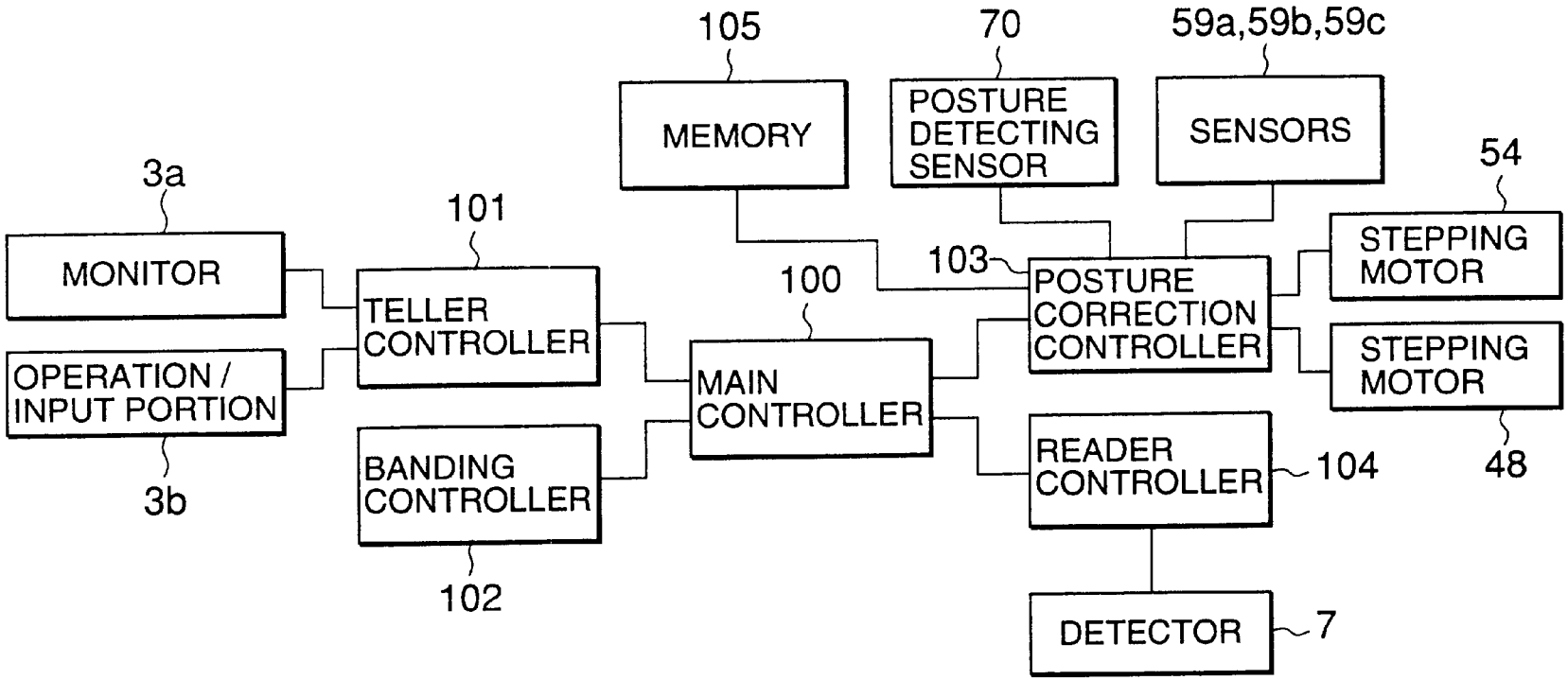
FIG. 4 is a block diagram of a control system which controls the operation of the posture correction device shown in FIG. 2.

FIG. 4 is a block diagram of a control system for controlling the above-mentioned operation of the posture correction mechanism 10.

The banknote receiving machine 1 has a main controller 100 that controls its entire operation. A teller controller 101 for controlling the teller machine 3 and a banding controller 103 for controlling the banding processor 4 are connected to the main controller 100. The above-mentioned monitor 3*a* and the operation/input portion 3*b* are connected to the teller controller 101.

Further, a posture correction controller 103 (a control portion/an operation portion) for controlling the posture correction device 10 in the banknote processing portion 2 and a reader controller 104 for controlling the detector 7 are connected to the main controller 100.

A memory 105 (a recorder) storing various data tables which are referred to during the operation by the posture correction device 10, a posture detecting sensor 70 (a detecting portion, a first detecting portion) for detecting banknotes P conveyed to the posture correction device 10 via the conveying path, the above-mentioned sensors 59*a*, 59*b* and 59*c* for detecting the rotating positions of the first and second correction mechanisms 32 and 33, the above-mentioned stepping motor 54 for rotating the correction rollers 37 and 38 of the first and second correction mechanisms 32 and 33 in the specified direction, and the above-mentioned stepping motor 48 for rotating the first and second correction mechanisms 32 and 33 themselves are connected to the posture correction controller 103.

The above-mentioned detector 7 is connected to the reader controller 104 for detecting features of banknotes P passed through the posture correction device 10. As described later, the detector 7 has two sets of sensors 7*a* and 7*b* (the second detecting portion) (see FIG. 6) for detecting magnetic characteristic of the feature portion printed on the surface at the positions one-sided in the longitudinal direction from the center of the banknotes P. Two sets of the sensors 7*a* and 7*b* are provided at the positions separately in the cross direction relative to the center line of the conveying path 6 facing the upward and downward directions of the conveying path 6. As the sensors 7*a* and 7*b* are provided facing the upward and downward direction of the conveying path 6, it is possible to detect magnetic characteristic of the portion of the features of banknotes P even when they are conveyed with the surface turned upward or downward.

Figure 5:
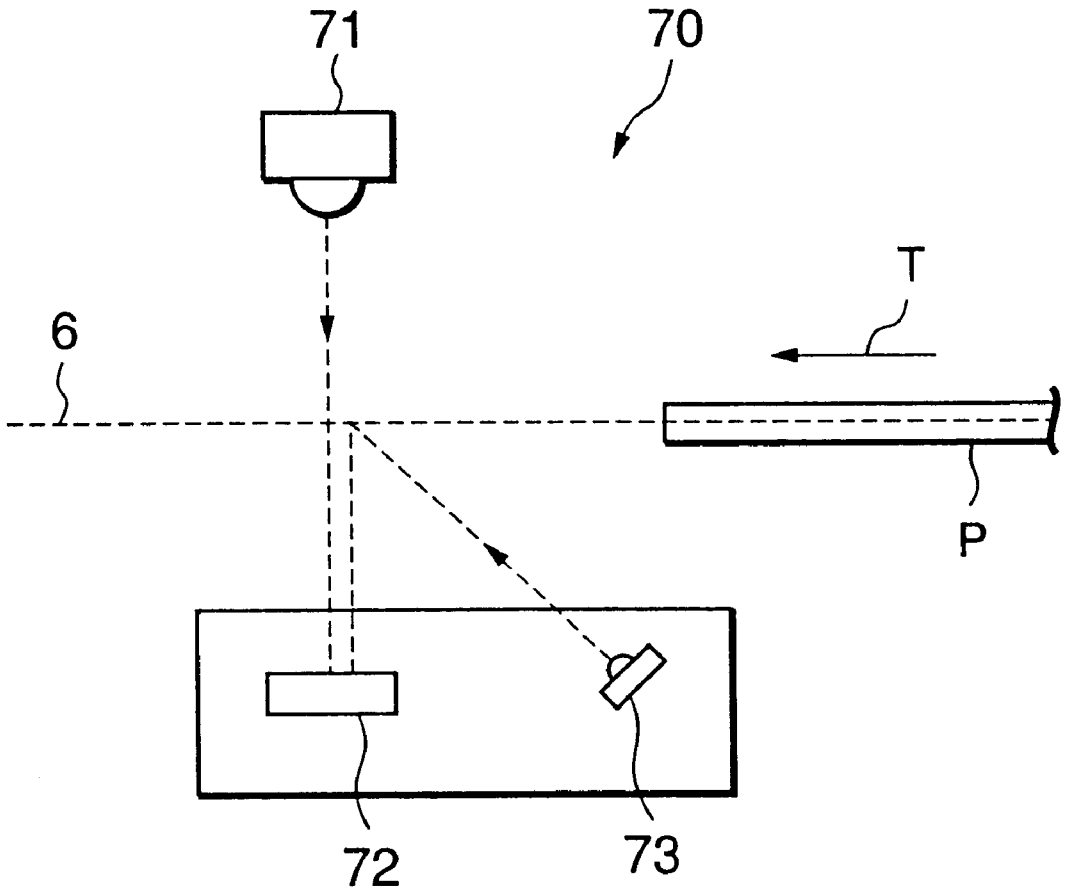
FIG. 5 is a schematic diagram for explaining the construction of a posture detecting sensor incorporated in the posture correction device shown in FIG. 2.

As shown in FIG. 5, the posture detecting sensor 70 has luminescent elements 71 such as LED provided above the conveying path 6 and light receiving elements 72 such as a photodiode provided below the conveying path 6 corresponding to the luminescent elements 71. Plural number of luminescent elements 71 are provided in parallel in the cross direction (the paper face direction) orthogonal to the conveying direction, and the light receiving elements are also provided in the same number of units in the same direction. These plural luminescent elements 71 and the light receiving elements 72 are so positioned that the positions of plural light axes to pass the conveying path 6 (see FIG. 6) are arranged in a line. Banknotes P are detected when the light axes are intercepted by banknotes P conveyed on the conveying path 6.

Further, the posture detecting sensor 70 has plural luminescent elements 73 provided below the conveying path 6. The luminescent elements 73 in the same quantity are provided in parallel with the above-mentioned light receiving elements 72 and coupled into one unit. The light emitted from these luminescent elements 73 is reflected on the lower surface of banknotes P conveyed on the conveying path 6 and led to the corresponding light receiving elements 72.

That is, the posture detecting sensor 70 detects the leading edge of banknote P in the conveying direction, that is, one of the longer side of the banknote P when the light axis is intercepted by a banknote P being conveyed on the conveying path 6. And based on this detected result, the length of the longer side, an angle of skew and amount of shift of the banknote P are calculated by the posture correction controller 103.

Further, the posture detecting sensor 70 detects a reflecting pattern based on the reflecting light that is reflected on a banknote P and from this pattern, detects kind of banknote P, directions relative to the front/back and top/bottom, bent, cut, missing, etc.

Further, in this embodiment, the posture detecting sensor 70 is split into two portions symmetrically centering around the center line 6*a* of the conveying path 6.

Next, the operation by the posture correction device 10 that is constructed as described above will be explained referring to FIG. 6 through FIG. 11.

Figure 6:
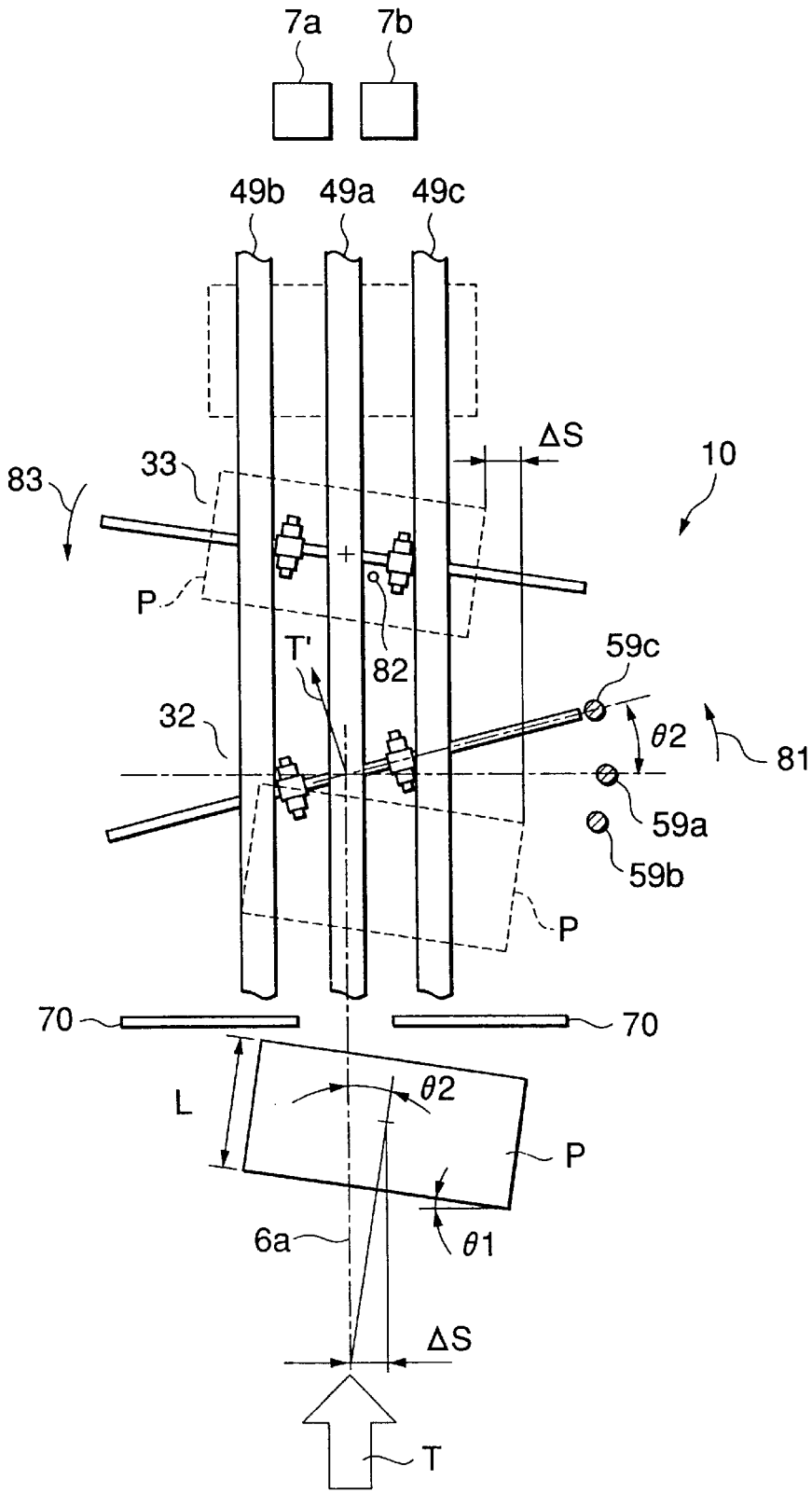
FIG. 6 is a plan view for explaining the operation by the posture correction device shown in FIG. 2.

FIG. 6 is a schematic diagram of the posture correction device 10 viewed from above the conveying path 6, and in addition to the structure of the posture correction device 10, two sets of the sensors 7*a* and 7*b* of the detector 7 above the conveying path 6 only are shown.

First, before starting the operation, an operation mode of the posture correction device 10 is selected by worker through the operation/input portion 3*b* connected to the tellers machine 3 of the banknote receiving machine 1. As the operation modes of the posture correction device 10, in addition to a centering mode for correcting the conveying posture of banknote P sent into the posture correction device 10 to the standard posture and sending out, there is a shift mode (an operation mode) for correcting the skew of the banknote P and shifting the conveying position of banknote P so that the feature portion of the banknote P passes through the sensor 7*a* or the sensor 7*b* of the detector 7.

When the centering mode is selected, various kinds of defects attributable to the improper postures of banknotes P can be prevented in the processing portions provided at the downstream side of the posture correction device 10. On the other hand, when the shift mode is selected, detecting accuracy when detecting features from the feature portions of the banknotes P through the sensors 7*a* and 7*b* of the detector 7 can be promoted.

First, the operation by the posture correction device 10 when the centering mode is selected through the operation/input portion 3*b* will be explained here. Further, the operation when the shift mode is selected will be explained later.

As shown in FIG. 6, a banknote P taken out on the conveying path 6 from the insert port 5 is conveyed in the arrow direction T in the clamped state by the first through third conveyor belts 49*a*–49*c* and passed the posture correction device 10 sequentially on the conveying path 6. Here, it is assumed that a skew θ1 and a shift ΔS shown by a solid line are caused on the banknote P passing through the posture correction device 10.

When the banknote P is sent into the posture correction device 10, the stepping motor 54 of the first correction mechanism 32 is driven and the correction rollers 37 and 38 are rotated in the conveying direction at a peripheral velocity equal to that of the conveying belts 49*a*–49*c*. Then, the longer side of the leading edge side of the banknote P in the conveying direction is detected via the posture detection sensor.

At this time, based on the detection result by the posture detecting sensor 70, the length [mm] of the longer side of the banknote P, amount of the positional shift of the center of the banknote P in the cross direction from the center line 6*a* of the conveying path 6, that is, the shift amount ΔS [mm] and an tilted amount of the longer side of the banknote P shifted from the cross direction orthogonal to the conveying direction T, that is, a skew angle θ1 [°] are calculated in the posture correction controller 103.

Further, at this point of time, the shorter side length L of a banknote P having the calculated length of a longer side is read from a data table stored in the memory 105 as shown in FIG. 7 together with the kind of that banknote P. In other words, in this embodiment when the longer side of the leading end of the banknote P in the conveying direction is detected, the shorter side length L of that banknote P can be obtained in a moment.

That is, for example, when German banknotes are processed, the length of the longer side is detected to be 130 [mm], this banknote is judged to be a 10 Deutsche mark banknote from the data table shown in FIG. 7 as the length of the longer side of Deutsche mark banknote differs depending on kind.

Further, when the length of the longer side of the banknote P is judged to be shorter than those of banknotes that can be processed by the machine based on the detection result, the banknote P is judged to be a bent or cut banknote. According to this judgment, the posture correction device 10 is put in the non-operating state and the banknote P is rejected into the rejection box 11 without executing the posture correction process.

When the shift amount ΔS, the skew angle θ1 and the shorter side length L of the banknote P are calculated in the posture correction controller 103 as described above, tan θ2 of tan θ2=ΔS/L is calculated in succession in the posture correction controller 103. Then, the stepping motor 48 is rotated and driven so as to rotate the first correction mechanism 32 by the angle of this θ2 shown in FIG. 6 by an arrow 81. At this time, the cylindrical shaft 43 of the first correction mechanism 32 and the drive shaft 44 rotate in the reverse direction; however, as the one-way clutch 55 runs idle, the rotating speed of the first correction mechanism 32 remains unchanged.

When a banknote P is sent into the first correction mechanism 32 in this state, the banknote P is conveyed while being clamped by the correction rollers 37 and 38. The banknote P conveyed by the correction rollers 37 and 38 is directed in the direction T' that is shifted by θ2 from the center line 6*a* of the conveying path 6. At this time, the banknote P is directed in the arrow direction T' while maintaining the skew angle θ1 and the positional shift in the cross direction only is corrected.

Then, at the timing of the leading edge of the banknote P passed through the first correction mechanism 32, that is, a timing of the banknote P clamped by the correction rollers 37 and 38 of the second correction mechanism 33, the second correction mechanism is rotated only by θ1 in an arrow direction 83 in the FIG. 6. Thus, the tilt of the banknote P is corrected when the second correction mechanism 33 is rotated in the state where the banknote P is clamped by the correction rollers 37 and 38.

The banknote P of which shift and skew are successively corrected by a series of control operations described above is conveyed to the detector 7 at the downstream side as a banknote P in the proper conveying posture after its posture is corrected and centered on the conveying path. Further, a banknote P out of those sent into the posture correction device 10, which has originally no skew and shift is conveyed to the detector 7 while kept in the proper posture without rotating the first and second correction mechanisms 32 and 33. Further, the proper posture referred to in this embodiment is a standard posture of a banknote P of which one side along the longitudinal direction is orthogonal to the center line 6*a* of the conveying path 6 and its center is positioned on the center line 6*a*.

During the posture correcting operation by the posture correction device 10 in the centering mode, the short side length L of a banknote P can be known when the leading edge at the longer side L of the banknote P in the conveying direction is detected by the posture detecting sensor 70 as described above and it is therefore possible to make the timing to start the operation by the first correction mechanism fast, a distance from the posture detecting sensor 70 to the first correction mechanism 32 short, and a size along the conveying direction of the posture correction device 10 small.

Further, when a banknote P is judged to be a bent or cut banknote by the posture correction controller 103, that banknote P is rejected into the rejection box 11 without operating the posture correction device 10 and therefore, it is possible to prevent such a defect to cause the jam in the posture correction device 10 without correcting the conveying posture of a bent or cut banknote by operating the posture correction device 10.

Next, the operation of the posture correction device 10 when the shift mode is selected by the operation/input portion 3*b* will be explained. Further, the explanation of the operations that are similar to the operations in the above-mentioned centering mode will be omitted and the operations differing from the centering mode only will be explained here in detail.

When the shift mode is selected and a banknote P is sent into the posture correction device 10 for processing, kind of a banknote P and directions relative to the front/back and top/bottom are detected in addition to the conveying posture, that is, skew and/or shift of the banknote P. There are four kinds of banknote directions. A banknote P which is taken out with the front turned upward and the upper end turned forward in the conveying direction is called a front-upward (FF: Face-Forward) banknote. A banknote P taken out with the front turned upward and the lower end turned fore in the conveying direction is called a front-rear (FR: Face-Reverse) banknote. A banknote P taken out with the back turned upward and the upper end turned forward in the conveying direction is called a back-forward (BF: Back-Forward) banknote. A banknote P taken out with the back turned upward and the lower end turned forward in the conveying direction is called a back-rear (BR: Back-Reverse) banknote.

A kind and a correction amount corresponding to the direction of a banknote P detected by the posture detecting sensor 70 are read out of a data table pre-stored in the memory 105 as shown in FIG. 8. Correction amounts contained in the data table shown in FIG. 8 are proper shift amounts for shifting conveying positions of banknotes P in the cross direction so that the feature portions of the banknotes P pass through the sensor 7*a* or 7*b* of the detector 7 when assuming that banknotes P of respective kinds and directions are set in the standard posture. These shift amounts are pre-calculated according to kinds and directions of banknotes P. Further, the data table shown in FIG. 8 shows shift amounts of Deutsche mark banknotes from the center line of the conveying path.

Figure 9A:
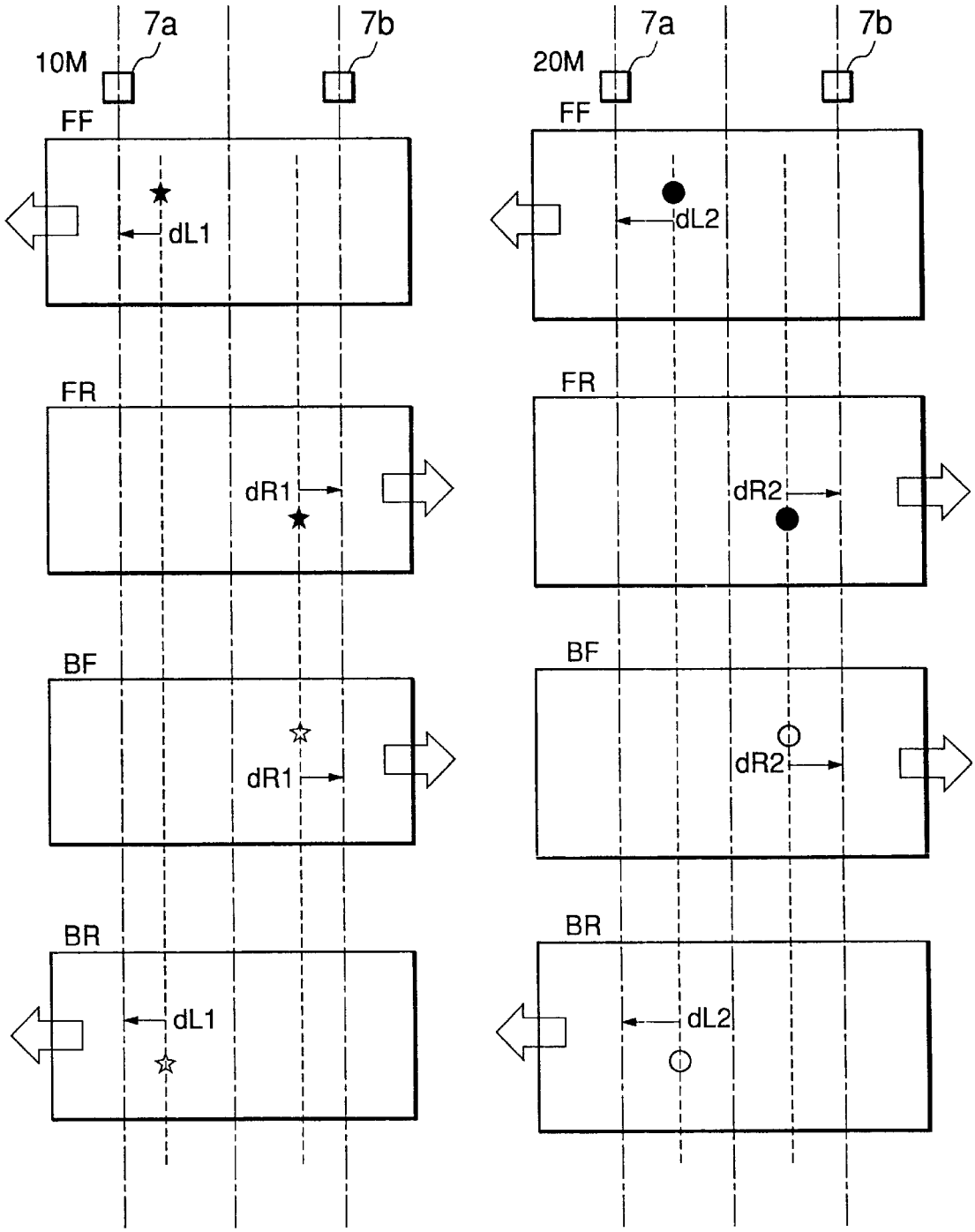
FIGS. 9A and 9B are schematic plan views showing the Deutsche mark banknote movement correcting state.
Figure 9B:
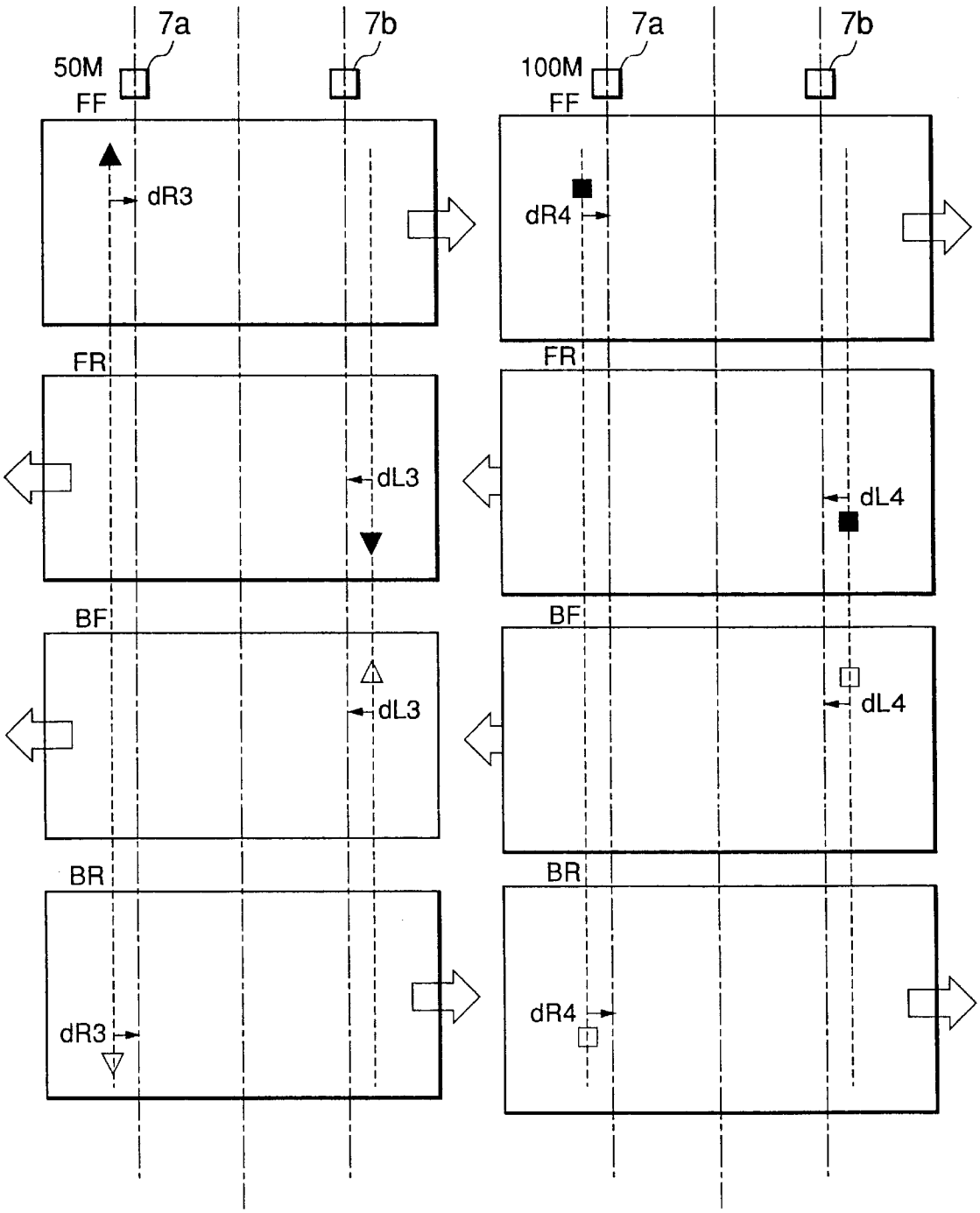

That is, as shown in FIG. 8, shift amounts of FF, FR, BF and BR banknotes which are conveying forms of 10, 20, 50 and 100 Deutsche mark banknotes, respectively, from the center line of the conveying path. Also, as shown in FIG. 9A, the feature portion "★" when a 10 mark banknote is being conveyed in the FF banknote state on the center line of the conveying path is shifted by a distance dL1 to the sensor 7*a*. Therefore, the feature portion "★" is moved in the left direction by a distance dL1 so as to shift a banknote P to the sensor 7*a* position. Further, the moving to the left is expressed by prefixing "←".

Further, as shown in FIG. 9A, the feature portion "☆" when a 10 mark banknote is being conveyed on the center line of the conveying path in the BF banknote state is shifted by a distance dR1 to the sensor 7*b*. Therefore, the feature portion "☆" is moved in the right direction by dR1 so as to shift the banknote P to the position of the sensor 7*b*. Further, the moving to the right is expressed by prefixing "→".

Similarly, when 20, 50 and 100 Deutsche mark banknotes are conveyed in the FF, FR, BF and BR banknote states, it is possible to move the banknotes based on the shift amounts from the center line of the conveying path shown in the data table shown in FIG. 8 so as to oppose the feature portions of the banknotes to the sensor 7*a* or 7*b*.

That is, a correction amount of a banknote P is obtained by adding a correction amount of the banknote P extracted from the data table to a correction amount for correcting skew and shift of the banknote P detected by the posture correcting sensor 70 to the standard posture. That is, as the correction amounts shown on the data table are pre-set based on the standard posture, a correction amount for shifting is added to a correction amount to correct the conveying posture of a banknote P to the standard posture.

Then, the posture correction device 10 is controlled and the conveying posture of a banknote P is corrected based on the correction amount calculated in the posture correction controller 103. Thus, even when all kinds of banknotes P are sent into the posture correction device 10 in any conveying postures, the banknotes P can be shifted so that the feature portions of the banknotes P pass through the detector 7 opposing to the sensor 7*a* or 7*b*.

Figure 10:
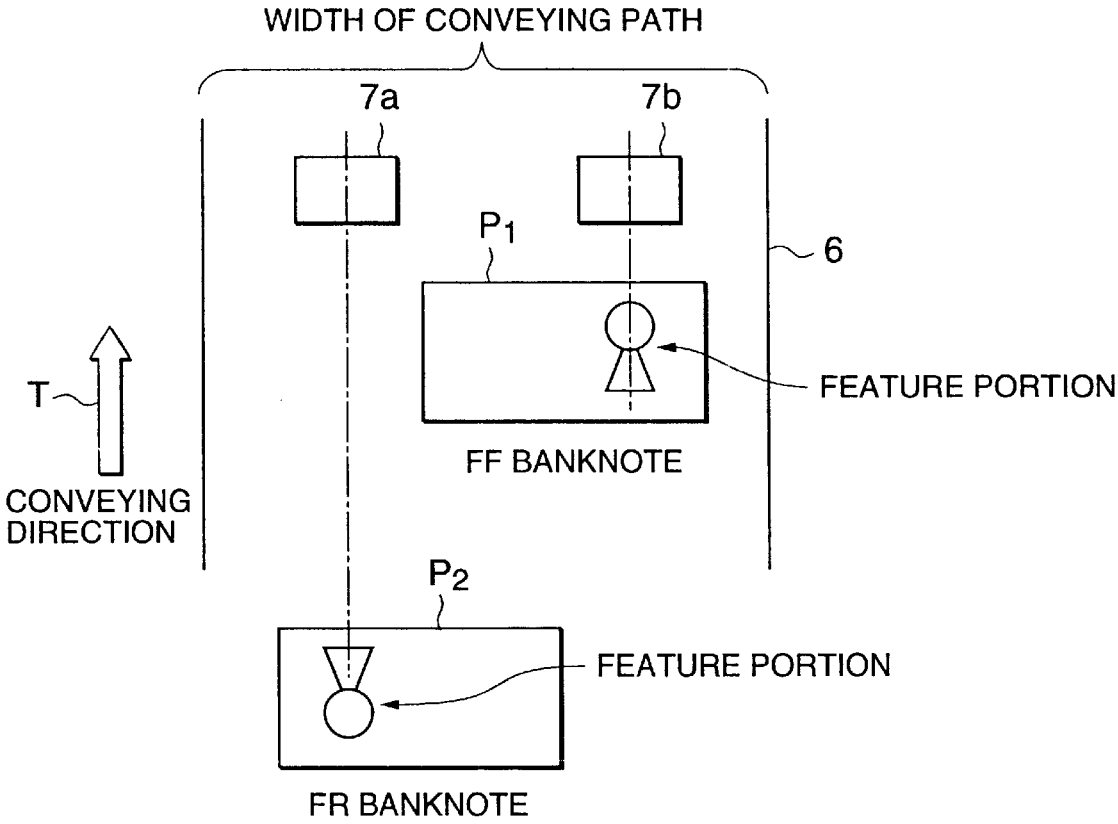
FIG. 10 is a schematic diagram for explaining the operation by the posture correction device in selecting the shift mode.

For example, the feature portion of a FF banknote P1 taken out on the conveying path 6 is one sided to the right side as shown in FIG. 10, the banknote P1 is slightly shifted in the right direction from the standard posture so that the feature portion is opposed to the sensor 7*b* at the upper right side above the conveying path 6. Further, for example, as the feature portion of the FR banknote P2 taken out on the conveying path 6 is one sided to the left side in the figure, the banknote P2 is slightly shifted in the left direction from the standard posture so that the feature portion is opposed to the sensor 7*a* at the upper left side of the conveying path 6. Further, the BF and BR banknotes that are not shown here are also shifted, respectively so that their feature portions are opposed to the sensor 7*a* or 7*b* provided below the conveying path 6.

When the shift mode is selected as described above, the feature portions of all banknotes P can be shifted to oppose to the sensor 7*a* or 7*b* of the detector 7 and detecting accuracy of the feature portions can be promoted. Further, as banknotes P are shifted to fit to the sensor position by shifting them, it is possible to reduce the number of sensors (the length in the cross direction), simplify the structure of the sensor 7 and reduce a manufacturing cost of the device. Further, 4 units of the sensor are set in this embodiment.

Further, the present invention is not limited to the embodiment described above but can be modified variously within the scope of the present invention. For example, in the above embodiment, a case wherein banknotes P in plural kinds are inserted into the insert port with the front/back and top/bottom put in the diverse directions are explained, but when banknotes P are inserted by uniformly arranging the directions relative to, at least, the front and back, the structure of the detector 7 can be more simplified. Definitely, when banknotes P are inserted with the front and back arranged in the uniform direction, the number of sensors of the detector 7 can be reduced to half.

Figure 11:
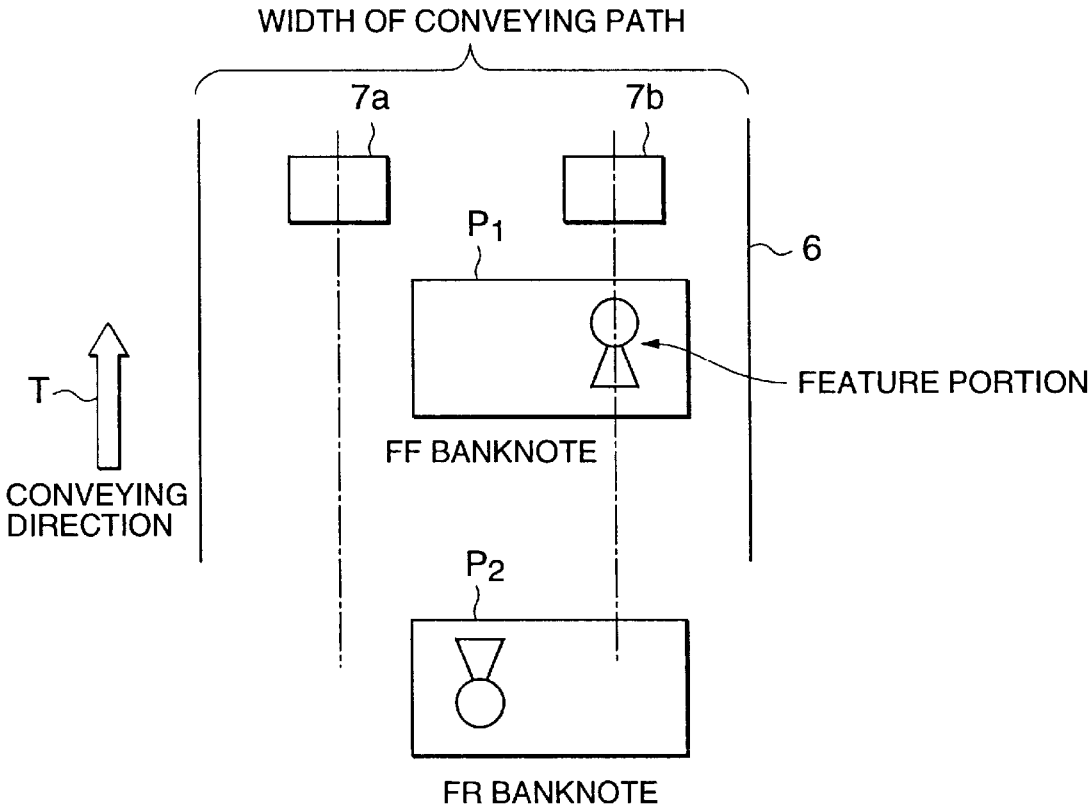
FIG. 11 is a schematic diagram for explaining the operation when banknotes are inserted by uniformly arranging the fronts and backs.

That is, in this case, as the front and back of all banknotes P are put in the uniform directions, all banknotes P are taken out on the conveying path 6 with the feature portions faced upward or downward on the conveying path 6. For example, all banknotes P are conveyed so that the feature portions are facing upward on the conveying path 6 as shown in FIG. 11.

In this case, a kind and the top/bottom direction of a banknote P are detected through the posture detecting sensor 70 and a banknote P that is detected to be an FF banknote is shifted slightly to the right direction from the standard posture according to its kind so that its feature portion is faced to the right side sensor 7*b* that is provided above the conveying path 6. A banknote P2 that is detected to be a FR bank note is slightly shifted to the left side from the standard posture so that its feature portion faces to the left side sensor 7*a* provided above the conveying path 6.

That is, when banknotes P are inserted with the front/back arranged uniformly, it becomes sufficient to provide a sensor at one side only and the number of sensors can be reduced to half (2 units here) when compared with the above-mentioned case wherein banknotes P are inserted in the state with the front/back arranged not in uniform direction.

Further, in this case, when a banknote P that is inserted in the state with the front turned backward or vice versa is taken out on the conveying path 6 as a BF or BR banknote (not shown), and its feature portion cannot be detected by the sensor 7*a* or 7*b* that is provided above the conveying path 6. Therefore, a banknote P that is judged to be a BF or BR banknote by the detector 7 is rejected in the rejection box 11.

Further, there is another method to detect a banknote P of a certain kind only by the posture detecting sensor 70 and shift that banknote P according to the result of this detection. According to this method, 2 kinds of banknotes P in the same nominal value, that is, FF and FR banknotes or BF and BR banknotes with the top/bottom reversed are shifted based on the same correction amount.

Figure 12:
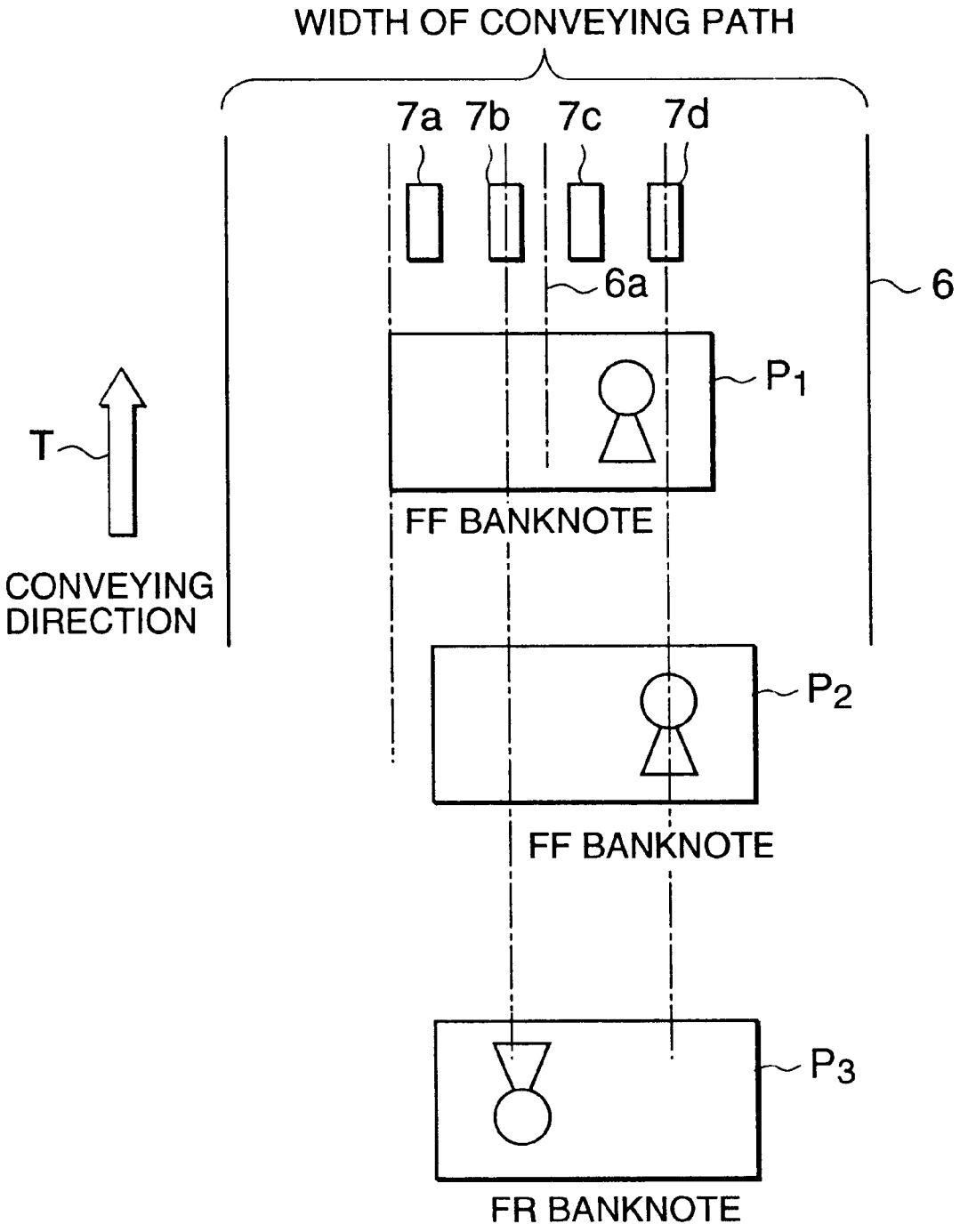
FIG. 12 is a schematic diagram for explaining other operations when banknotes are inserted by uniformly arranging the fronts and backs.

For example, FF banknote P2 and FR banknote P3 in the same nominal value are shifted to the same position along the cross direction as shown in FIG. 12. In this case, the feature portion of the FF banknote P2 is opposed to the sensor 7*d* at the most right end and the feature portion of FR banknote P3 are opposed to the third sensor 7*b* from the left. In other words, when two sensors are provided above or below the conveying path 6 according to respective kinds, banknotes P of the same kind with the top/bottom reversed can be processed as the same banknotes.

According to this method, although the number of sensors are increased, it is needed only to detect kinds of banknotes P through the posture detecting sensor 70, it becomes possible to simplify the signal process and increase the process speed.

Further, when banknotes P are inserted into the insert port with the front/back and the top/bottom arranged uniformly, the number of sensors 7*a* and 7*b* can be further reduced. Here, the sensor is reduced to one unit.

That is, when banknotes P are inserted with the front/back and the top/bottom arranged uniformly, for example, all banknotes P are taken out on the conveying path likewise the FF banknote P1 shown in FIG. 11. In this case, because the feature portions of banknotes P always come to the position one sided to the right side above the conveying path 6, the sensor 7*a* at the left side can be eliminated. That is, when banknotes P are inserted with the front/back and the top/bottom arranged uniformly, only one sensor 7*b* at the right side above the conveying path 6 will be sufficient.

Further, in this case, for example, a FR banknote P2 inserted with the front/back and the top/bottom arranged not in uniform directions as shown in FIG. 11 is rejected into the rejection box 11 according to the detection result in the detector 7 as its feature portion cannot be detected.

As described above, according to this embodiment, the processing form of banknotes P can be changed optionally by variously changing the numbers of units and arranging positions of sensors 7*a* and 7B of the detector 7 and directions of the front/back and the top/bottom of banknotes P that are inserted into the insert port 5.

As described above, the paper-like materials processing apparatus of this invention is in the structure and has actions as described above, it is possible to simplify the structure of the detector for detecting features of paper-like materials and detect features of paper-like materials precisely.

What is claimed is:

1. A paper-like materials processing apparatus comprising:

an insert port into which paper-like materials are inserted;

a conveying portion to convey the paper-like materials taken out on a conveying path from the insert port;

a first detecting portion to detect kinds and directions relative to the front/back and the top/bottom of the paper-like materials being conveyed by the conveying portion;

a posture correcting portion to correct the conveying posture of the paper-like materials passed through the first detecting portion;

a second detecting portion to detect features of the paper-like materials from feature portions by being located opposite to the feature portion of the paper-like materials passed through the posture correction portion;

a storage portion to store position correction amounts by the posture correcting portion that is pre-set according to kinds and directions of paper-like materials so that the feature portions of paper-like materials passed through the posture correcting portion are opposed to the second detecting portion; and a controller to control the posture correcting portion to correct the conveying posture of paper-like materials according to position correction amounts corresponding to kinds and directions of paper-like materials detected by the first detecting portion read out from the storage portion.

2. A paper-like materials processing apparatus according to claim 1, wherein the insert port accepts the insertion of paper-like materials accumulated with the front/back arranged uniformly.

3. A paper-like materials processing apparatus according to claim 1, wherein the insert port accepts the insertion of paper-like materials accumulated with the front/back and the top/bottom arranged uniformly.

4. A paper-like materials processing apparatus according to claim 1, 2 or 3, further comprising:

a mode selecting portion to select an operation mode to correct the conveying posture of paper-like materials so that the feature portions of the paper-like materials oppose to the second detecting portion;

wherein the controller reads the position correction amount corresponding to kind and direction of paper-like materials detected through the first detecting portion from the storage portion when the operation mode is selected by the mode selecting portion and corrects the posture correcting portion so as to correct the conveying postures of paper-like materials according to the read correction amount.

5. A paper-like materials processing apparatus according to claim 1, 2 or 3, further comprising:

a mode selecting portion to select an operation mode to correct the conveying posture of the paper-like materials so that the centers of the paper-like materials taken out in the cross direction are positioned on the center line of the conveying path, and the long side along the longitudinal direction of the paper-like materials becomes orthogonal to the center line;

wherein the controller controls the posture correcting portion to correct the conveying posture of the paper-like materials so that the center of the paper-like materials positioned on the center line of the conveying path and the long side along the longitudinal direction of the paper-like materials becomes orthogonal to the center line.

6. A paper-like materials processing apparatus according to claim 1, 2 or 3, further comprising:

a rejection portion to reject paper-like materials of which features could not be detected by the second detecting portion.

7. A paper-like materials processing apparatus according to claim 1, 2 or 3, wherein the second detecting portion includes sensors to detect magnetic characteristics of the feature portions of the paper-like materials.

8. A paper-like materials processing apparatus according to claim 7, wherein the sensors are arranged so as to oppose to the feature portions of the paper-like materials being conveyed with the fronts turned upward and the tops directed to the forward of the conveying direction.

9. A paper-like materials processing apparatus according to claim 7, wherein the sensors are arranged so as to oppose to the feature portions of the paper-like materials being conveyed with the fronts turned upward and the bottoms directed to the forward of the conveying direction.

10. A paper-like materials processing apparatus according to claim 7, wherein the sensors are arranged so as to oppose to the feature portions of the paper-like materials being conveyed with the backs turned upward and the tops directed to the forward of the conveying direction.

11. A paper-like materials processing apparatus according to claim 7, wherein the sensors are arranged to oppose to the feature portions of the paper-like materials being conveyed with the backs turned upward and the bottoms directed to the forward of the conveying direction.

12. A paper-like materials processing apparatus comprising:

an insert port into which rectangular shaped paper-like materials are inserted;

a conveying portion to convey paper-like materials taken out from the insert port to a conveying path in a posture such that the long sides along the longitudinal direction of the rectangular shape paper-like material become orthogonal to the conveying direction;

a detecting portion to detect the leading edge of the paper-like materials in the conveying direction being conveyed by the conveying portion;

an operating portion to calculate length, tilt and positional shift amounts of paper-like materials based on the detection results of the detecting portion;

a storage portion to store lengths of short sides of the paper-like materials along the short direction by kind of paper-like materials corresponding to the length of the long side; and a posture correcting portion to read lengths of short sides of paper-like materials corresponding to lengths of long sides calculated in the operating portion from the storage portion and correct the conveying posture of the paper-like materials based on the tilt and positional shift amounts of the paper-like materials calculated by the operating portion.

* * * * *